US005197036A

United States Patent [19]

Buckingham

[11] Patent Number: 5,197,036

[45] Date of Patent: Mar. 23, 1993

[54] SONAR ARRAY MOUNTING FOR SONOBUOY

[75] Inventor: David E. J. Buckingham, Middlesex, Great Britain

[73] Assignee: Dowty Maritime Limited, Feltham, England

[21] Appl. No.: 773,616

[22] PCT Filed: Mar. 15, 1991

[86] PCT No.: PCT/GB91/00403

§ 371 Date: Jan. 13, 1992

§ 102(e) Date: Jan. 13, 1992

[87] PCT Pub. No.: WO91/14259

PCT Pub. Date: Sep. 19, 1991

[30] Foreign Application Priority Data

Mar. 15, 1990 [GB] United Kingdom ..... 9005863

[51] Int. Cl.[5] ..... H04R 1/00; G10K 11/00

[52] U.S. Cl. ..... 367/4; 367/153

[58] Field of Search ..... 367/4, 153, 165, 173; 114/326; 441/33

[56] References Cited

U.S. PATENT DOCUMENTS 3,290,642 12/1966 Mason et al. ..... 367/4

4,656,616 4/1987 Bennett et al. ..... 367/153

FOREIGN PATENT DOCUMENTS 2315817 1/1977 France .

2217456 10/1989 United Kingdom .

OTHER PUBLICATIONS

"A Buoy Supported Acoustical Data Acquisitiion System", *IEEE Transactions On Geoscience Electronics*, vol. GE-7, No. 4, Oct. 1969, By H. Waugh, Jr., pp. 226-234.

*Primary Examiner*—Daniel T. Pihulic

*Attorney, Agent, or Firm*—Young & Thompson

[57] ABSTRACT

A sonobuoy comprises a sonar array mounted on arms 2 that are pivotally connected to a central support 3 and housed by an outer housing 1. Upon entry of the sonobuoy into water a float 8 is deployed which since it is connected to the central support 3 by a line arrests the downward motion of the central support 3. The outer housing 1, by virtue of its inertia, travels on uncovering the arms 2 and positively locating the arms 2 by pulling on lines 17 connected to the arms 2. The use of the motion of the housing 1 to deploy the arms 2 eliminates the requirement for spring powered motors reducing the cost of the sonobuoy.

5 Claims, 3 Drawing Sheets

SONAR ARRAY MOUNTING FOR SONOBUOY

FIELD OF THE INVENTION

This invention relates to sonar arrays and means to deploy them underwater.

BACKGROUND OF THE INVENTION

A known type of sonobuoy incorporates acoustic sensors which are contained in a housing until such time as the sonobuoy is dropped into the water, at which time the sensors are released from the housing as an array to detect acoustic signals in the water. The sonobuoy incorporates a float from which the array is suspended by a line and which serves to pull the array out of the housing when it has descended to a depth determined by the length of the line. Fastening means may be provided to retain the array within the housing during descent, but which is released by the inertial force exerted by the housing when the line is fully extended. Once pulled out of the housing, the array may be deployed by gravity or spring means. However, deployment of the array in this way may not be sufficient to ensure fully effective deployment.

In other known types of sonobuoy, drive means is provided to positively deploy the sensor array.

For example, spring powered motors may be provided which are connected to pivoted arms carrying the sensors so that these arms are swung outwards from a tubular configuration to a star-shaped configuration when the motors are operated. However, the provision of such drive means complicates the design of the sonobuoy and increases its cost.

SUMMARY OF THE INVENTION

An object of the present invention is to provide improved means to deploy a sonar array effectively underwater.

This is achieved according to the invention by mounting the array on a plurality of arms that are pivotally connected together on a central support so that they can pivot downwards and outwards from an upwardly extending, non-deployed orientation, an outer housing being provided which contains the non-deployed arms and which is adapted to move axially to uncover the arms when the array is to be deployed, each arm being connected via a tie to the outer housing so that such axial movement of the housing then positively moves the arms to their radially deployed orientation.

Preferably, the central support is connected via a suspension line to a float so that the length of the line determines the depth at which the array is deployed, the inertia of the housing causing it to continue to descend and uncover the arms when downwards movement of the central support and arms is arrested by the suspension line. The housing then falls free and inertial forces pull the arms outwards through the ties.

Preferably, the arms are held together in their non-deployed orientation by fastening means which is released by the initial relative movement between the housing and arms. The fastening means may take the form of a spring ring released by a pin connected by a release cord to the housing.

BRIEF DESCRIPTION OF THE DRAWINGS

The invention will now be described by way of example with reference to the accompanying drawings in which.

DETAILED DESCRIPTION OF THE INVENTION

Figure 1:
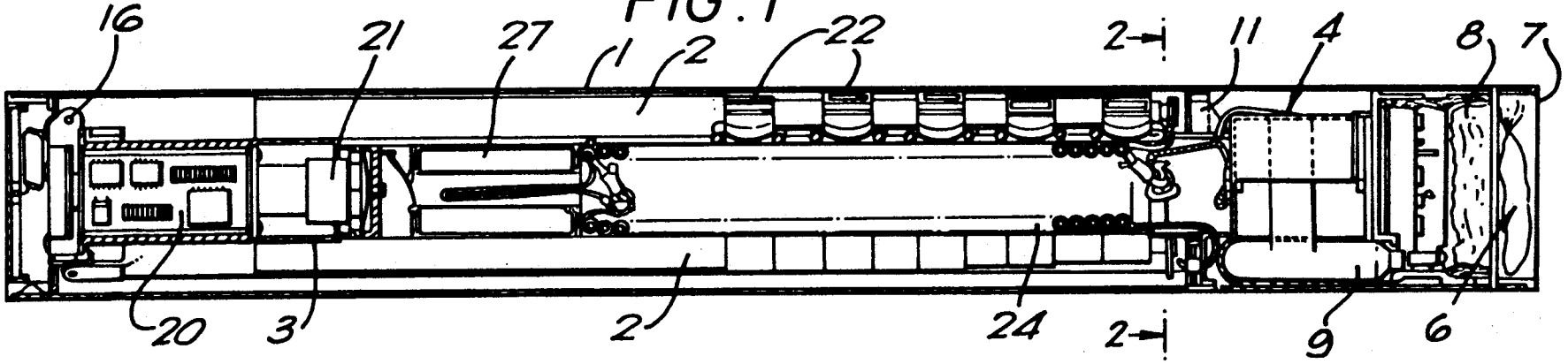
FIG. 1 is an axial section through a sonobuoy incorporating the present invention.
Figure 2:
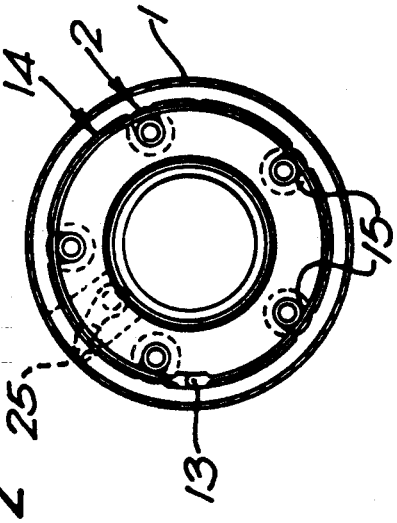
FIG. 2 is a section along the line 2—2 in FIG. 1.

The illustrated sonobuoy comprises an outer tubular housing 1 which contains a folded sonar array comprising five telescopic arms 2 each pivotally connected at its lower end to the lower end of a central tubular support 3. A surface float assembly 4 is mounted within the housing 1 above the folded array and is connected to the array via a suspension line 5 which is coiled in the space between the five folded arms 2. A parachute 6 is mounted at the top of the housing in a container 7 which closes the housing.

When deployed from an aircraft, the sonobuoy is ejected and the parachute container 7 is opened automatically to release the parachute 6. Once the sonobuoy hits the sea and sinks, a water-sensitive switch (not shown) operates to cause the float 8 to be inflated with carbon dioxide gas from a compressed gas bottle 9. Inflation of the float assembly ejects the parachute container 7 from the top of the housing 1 and allows the float 8 to rise to the surface of the sea. The housing 1 containing the folded array continues to sink, paying out the suspension line 5 in the process.

Figure 3:
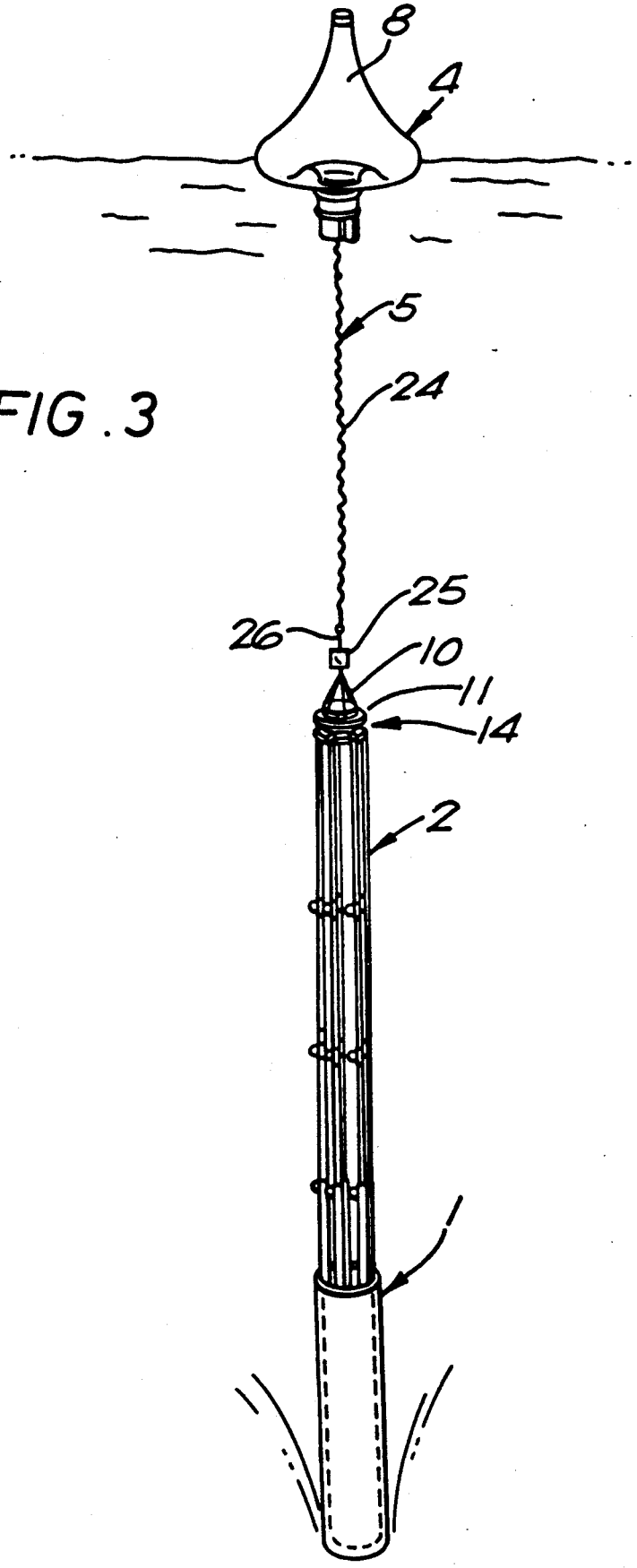
FIG. 3 shows the sonobuoy of FIG. 1 partially deployed.

The suspension line 5 comprises a compliant section 24 which is connected at its lower end to a bobbin 11 with peripheral notches 15 in which the upper ends of the arms 2 are retained by a locked spring ring 14. A depth selector mechanism 25 is connected between the compliant section 24 and bobbin 11 by a short nylon lanyard 26 and a set of cords 10. At a first preselected depth the suspension line 5 is pulled taut, and applies an axial upwards force to the bobbin 11 and five arms 2, causing them to be extended (see FIG. 3). The suspension line 5 then arrests the descent of the array, but the inertia of the housing 1 causes it to continue to descend and operate a cord 12 which releases the upper ends of the arms 2 from the bobbin 11. The cord 12 is connected to a pin 13 which locks together the ends of the spring ring 14 encircling the bobbin 11. When the cord 12 is pulled taut, the pin 13 is removed to unlock the spring ring 14. The upper ends of the arms 2 are then freed.

Figure 4:
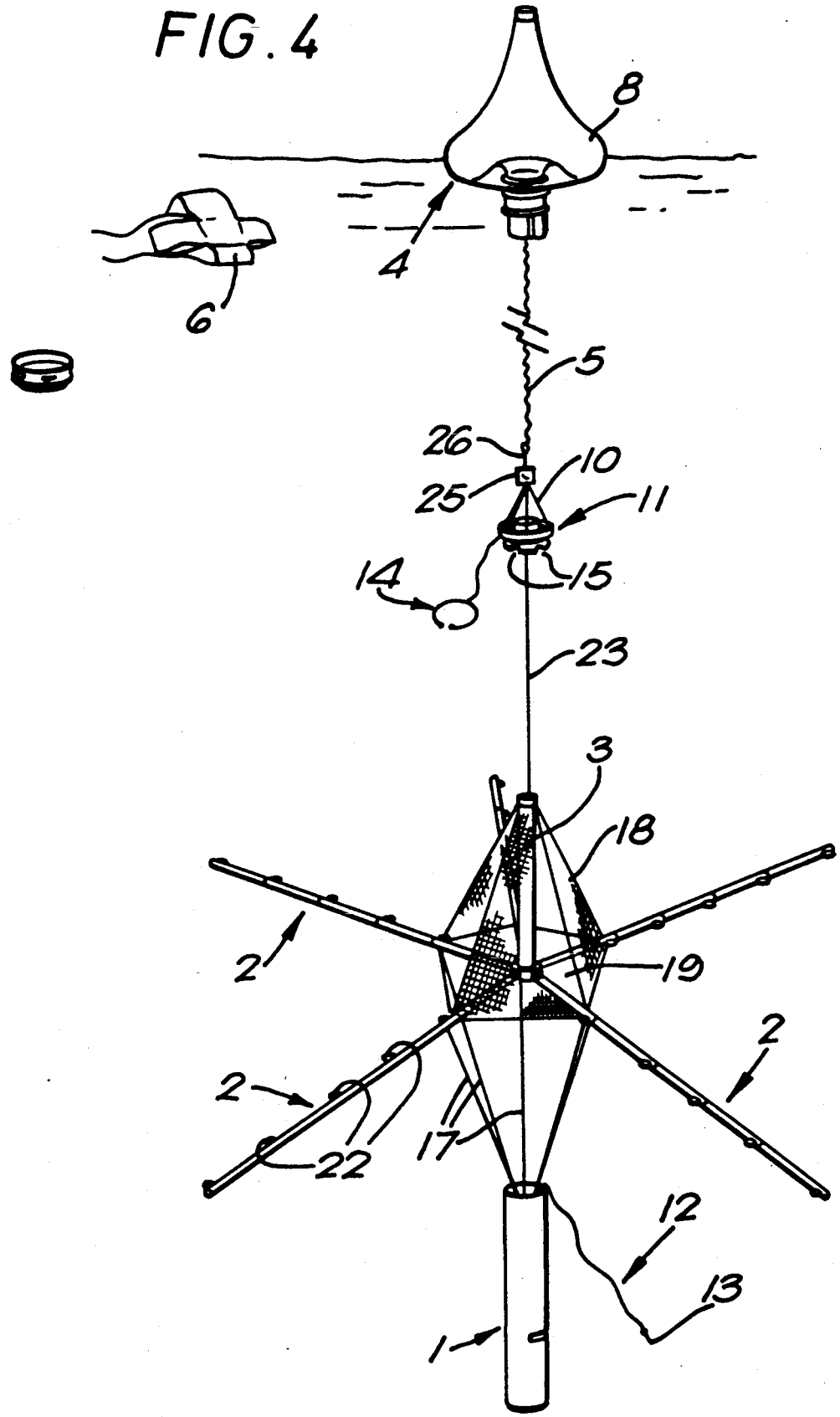
FIG. 4 shows the sonobuoy of FIG. 1 fully deployed.

As downwards movement of the housing 1 continues, the folded arms 2 are fully uncovered so that they are free to fold downwards. The pivotal axis 16 between the bottom of each arm and the central support 3 is offset radially inwards from the upright longitudinal axis of the arm so that the weight of the latter tends to cause it to pivot outwards. Furthermore, each arm 2 is connected via a cord 17 (FIG. 4) to the upper end of the housing 1 so that the final downwards movement of the housing 1 tensions these cords 17 to pull all five arms outwards and downwards to their radially deployed orientation.

In the fully deployed state, the array is suspended from the suspension line 5 by a nylon cord 23 which is connected between the depth selector mechanism 25 and the central support 3. A signal cable 27 is connected between an electronics unit 20 in the support 3 and a radio transmitter (not shown) in the surface float assembly 4. This cable 27 is initially stored with the suspension line 5 in the support 3 and the two pay out together as the housing 1 sinks in the water during deployment. At said first preselected depth, not all of the cable 27 has paid out, and the cord 23 is attached to that portion of the cable 27 still stored within the support 3. However, if it is required to deploy the array at a second preselected deeper depth, the lanyard 26 is disconnected by the depth selector mechanism 25 so that all of the cable 27 pays out before descent of the housing 1 is arrested, when the cable 27 and cord 23 go taut. The array is then extended and deployed radially as described above for the first preselected depth.

Panels 18 of flexible material are connected between adjacent pairs of arms 2 and the top of the central support 3 so as to be tensioned when the arms are deployed. These panels 18 serve to reduce the velocity of tidal flow across the deployed array. Further panels 19 of flexible material are connected between adjacent pairs of arms 2 so as to be tensioned when the arms are deployed and form a horizontal damping vane which together with the compliant suspension line 5 damps vertical movement of the array.

The tubular central support 3 houses a compass 21 as well as the electronics unit 20 of the sonobuoy. The acoustic sensors take the form of hydrophones 22 spaced along the length of each arm 2 and connected to the electronics unit 20. Acoustic signals picked up by the hydrophones are processed in the electronics unit and transmitted via the signal cable 27 to the radio transmitter in the surface float assembly 4.

I claim:

1. A sonobuoy comprising a sonar array mounted on a plurality of arms that are pivotally connected together on a central support so that they can pivot downwards and outwards from an upwardly extending, non-deployed orientation, an outer housing being provided which contains the nondeployed arms and which is adapted to move axially to uncover the arms when the array is to be deployed, each arm being connected via a tie to the outer housing so that such axial movement of the housing positively moves the arms to their radially deployed orientation, said outer housing depending downwardly from the arms in their deployed state.

2. A sonobuoy as claimed in claim 1 comprising a float and a suspension line connected to the float and the central support such that, in use, the length of the line determines the depth at which the array is deployed by arresting the downwards movement of the central support.

3. A sonobuoy as claimed in claim 1 comprising fastening means by which the arms are held together in their non-deployed orientation, the means being released by the initial relative movement between the housing and arms.

4. A sonobuoy as claimed in claim 3 wherein the fastening means comprises a spring ring, which encircles upper ends of the arms when non-deployed, a pin for locking the ring and a release line connected to the pin and the outer housing such that the pin is removed unlocking the ring and releasing the arms by the initial relative movement between the housing and arms.

5. A sonobuoy as claimed in claim 2 wherein the suspension line is a compliant suspension line which in use, damps vertical movement of the array.

* * * * *